US005413723A

United States Patent [19]

Munteanu et al.

[11] Patent Number: 5,413,723

[45] Date of Patent: May 9, 1995

[54] USE OF SPECIAL SURFACTANTS TO CONTROL VISCOSITY IN FABRIC SOFTENERS

[76] Inventors: Marina A. Munteanu, 301 E. 64th St., Apt. 5C, New York, N.Y. 10021; Peter J. Keane, 3336 Boyd St., Boonton, N.J. 07005; Alison Betz, 303 Valley St., Atlantic Highlands, N.J. 07716; Eric P. Guénin, 102 Canterbury Ct., Piscataway, N.J. 08854; Leslie C. Smith, 29 Grovers Mill Rd., Plainsboro, N.J. 08536

[21] Appl. No.: 168,198

[22] Filed: Dec. 17, 1993

[51] Int. Cl.[6] ..... D06M 11/00

[52] U.S. Cl. ..... 252/8.6; 252/8.9; 512/2

[58] Field of Search ..... 512/2; 252/8.6, 8.9

[56] References Cited

U.S. PATENT DOCUMENTS

| | | | |
|---|---|---|---|
| 4,446,032 | 5/1984 | Munteanu et al. | 252/8.6 |
| 5,190,915 | 3/1993 | Behan et al. | 512/2 |
| 5,236,614 | 8/1993 | Jacquet et al. | 252/96 |
| 5,252,555 | 10/1993 | Dartnell et al. | 512/4 |

FOREIGN PATENT DOCUMENTS

0466236A1 1/1992 European Pat. Off. .

*Primary Examiner*—Mark L. Bell
*Assistant Examiner*—C. M. Bonner

[57] ABSTRACT

Control of fabric softener viscosity by increasing the amount of fragrance in the formulation and to thereby influence the amount of fragrance that can be added to the fabric softening formulations. A mixture of a perfume or fragrance chemical and special group of surface active agents is prepared. Thereafter the mixture is added to a fabric softener base formulation to produce the fabric softener consumer product.

2 Claims, No Drawings

USE OF SPECIAL SURFACTANTS TO CONTROL VISCOSITY IN FABRIC SOFTENERS

BACKGROUND OF THE INVENTION

The present invention relates to a method of controlling the viscosity of fabric softening compositions and, more particularly, to a method for avoiding gelation or gel formation of fabric softener compositions.

Fabric softening agents are used in order to improve the feel and texture of fabrics and to improve the comfortability of fabrics in actual wear. Typically, fabric softening agents are applied from an aqueous liquid which is made up by adding a relatively small amount of a fabric softening composition to a large amount of water, for example during the rinse cycle in an automatic washing machine. The fabric softening composition is usually an aqueous liquid product containing less than about 8% of a cationic fabric softening agent which is a quaternary ammonium salt. Such compositions are normally prepared by dispersing in water a cationic material, for example quaternary ammonium compounds which in addition to long chain alkyl groups may also contain ester or amide groups. It is also advantageous to use mixtures of different fabric softening components which are typically added to the last wash cycle rinse both in the form of aqueous dispersions.

It is widely known that fragrances can be introduced into liquid fabric softener compositions in order to cause the treated fabrics to have aromas with good initial strength. Efforts have also been made to develop systems in which aromas are controllably released during the normal conditions of use of the fabrics treated with solutions created from the liquid softening compositions of matter at a predictable sufficiently high level over an extended period time.

It is recognized in the prior art that perfume containing particles of a defined melting point and size can be incorporated into compositions containing fabric softening components. Typical of such prior art is Canadian Patent 1,111,616, German OLS 2631129, German OLS 2702162, U.S. Pat. Nos. 4,234,627 and 4,464,271.

However it has been found that when the amount of fragrance is increased beyond just one, two or three percent, there is a tendency for the fabric softener base formulation to gel. Undesirable gelation of the fabric softener reduces the shelf life of the product and may cause an adverse consumer reaction when the person using the fabric softener opens the container and finds that the fabric softener has formed a gel like, highly viscous mass instead of being free flowing.

This tendency of gel formation has prevented the utilization of larger amounts of the customary fragrances or the use fragrances with a relatively weak aroma creating power, in larger amounts.

Various efforts have been made to influence the viscosity of fabric softeners to overcome certain problems and to improve properties. For example, low viscosity concentrated products as shown in U.S. Pat. No. 3,681,241 containing ionisable salts, fatty acids, fatty alcohols, fatty esters and paraffinic hydrocarbons. See also European patent 13780.

It has also been proposed in European patent specification 56695 to control the viscosity of concentrated products by the use of small amounts of alkoxylated amines.

Still further developments are shown in U.S. Pat. No. 4,497,716 where there is disclosed a concentrated liquid fabric softening composition which contains a water soluble cationic fabric softening agent, a nonionic viscosity control agent and an electrolyte. The viscosity control agent is an alkylene oxide adduct of a fatty compound selected from fatty amines, fatty alcohols, fatty acids and fatty esters.

It is therefore an object of the present invention to provide a way to avoid gelation of fragrance containing fabric softening agents and also to provide a way to permit the introduction of an increased amount of fragrance into a fabric softening composition.

SUMMARY OF THE INVENTION

It is an object of the present invention to provide a method for controlling the viscosity of a fabric softener to thereby enable the production of fabric softeners which have a reduced tendency to gel.

It is a further object of the present invention to provide for the control of fabric softener viscosity by increasing the amount of fragrance in the formulation and to thereby influence the amount of fragrance that can be added to the fabric softening formulations.

In achieving the above and other objects, one feature of the present invention resides in a method for controlling viscosity of a fabric softener by first preparing a mixture of a perfume or fragrance chemical and special group of surface active agents. Thereafter the mixture is added to a fabric softener base formulation to produce the fabric softener consumer product.

DETAILED DESCRIPTION OF INVENTION

In carrying out the present invention, there is provided a method for avoiding the gelation of fabric softeners by mixing a perfume component and one or more or a special group of surface active components. Subsequently, this mixture is compounded with a customary fabric softener base formulation in accordance with conventional technology.

A feature of the present invention resides in forming a mixture of a perfume with one or more alkoxylated fatty alcohols, more particularly polyethylene glycol ethers of cholesterol or cetyl alcohol. The mixture of the perfume/aroma chemical and alkoxylated fatty alcohol surrounds and protects the dispersed perfume.

According to the invention the mixture is produced by first forming a non-aqueous phase comprising the perfume and alkoxylated fatty alcohol and optionally other adjuncts, which is mixed at a temperature at which the non-aqueous phase forms a homogeneous liquid.

The mixture herein contain 10–95% by weight of perfume.

Optionally, other hydrophobic adjuncts may be mixed with the perfume and thus be present in the non-aqueous phase at a total level of 0–30% by weight of the non-aqueous phase. For the purpose of this invention it is necessary that the total perfume or perfume/hydrophobic adjunct mixture is hydrophobic in nature as otherwise the mixture will not form correctly. With the expression "hydrophobic" as used herein is meant a material which will be soluble in one or more organic solvents such as ethanol, acetone or hydrocarbon solvents and will not exhibit an appreciable degree of solubility in water.

The alkoxylated fatty alcohol surfactants will preferably be present in the mixture at 5–90% by weight, more preferably 5–50%; the perfume (or perfume/hydrophobic adjuncts mixture) preferably at 10–95% by weight, more preferably 50–95%. It is particularly suitable that the weight ratio of the total surfactant to perfume lies within the range 0.1:1 to 0.2:1.

By using the fragrance/surfactant mixture of the present invention instead of adding a fragrance oil to a fabric softener base it is possible to obtain a relative decrease in the viscosity of the final fabric softener product. Thus it is possible to avoid long term irreversible thickening of the fabric softener and allow maintenance of a pourable product.

Among the fabric softening base formulations that can be used in accordance with the present invention, there are any of the well known species of substantially water insoluble mono-ammonium compounds which are the quaternary ammonium and amine salt compounds having the formula:

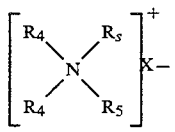

wherein each $R_4$ represents alkyl or alkenyl groups of from about 12 to about 24 carbon atoms optionally interrupted by amide, propyleneoxy groups and the like. Each $R_5$ represents hydrogen, alkyl, alkenyl or hydroxyalkyl groups containing from 1 to about 4 carbon atoms; and X is the salt counteranion, preferably selected from halide, methyl sulphate and ethyl sulfate radicals. Such materials are well known in the art.

Representative examples of these quaternary softeners include ditallow dimethyl ammonium chloride, ditallow dimethyl ammonium methosulphate; dihexadecyl dimethyl ammonium chloride; di(hydrogenated tallow alkyl)dimethyl ammonium chloride; dioctadecyl dimethyl ammonium chloride; diecosyl dimethyl ammonium chloride; didocosyl dimethyl ammonium chloride; di(hydrogenated tallow)dimethyl ammonium methyl sulphate; dihexadecyl diethyl ammonium chloride; di(coconut alkyl)dimethyl ammonium chloride; di(coconut alkyl)dimethyl ammonium methosulphate; di(tallowyl amido)ethyl dimethyl ammonium chloride and di(tallowyl amido)ethyl methyl ammonium methosulphate. Of these, ditallow dimethyl ammonium chloride and di(hydrogenated tallow alkyl)dimethyl ammonium chloride are preferred.

Another preferred class of water-insoluble cationic materials which can be present in the fabric softener base are the alkyl imidaolinium salts believed to have the formula:

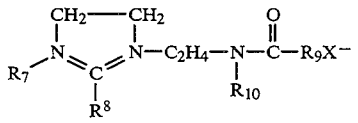

wherein $R_7$ is hydrogen or an alkyl containing from 1 to 4, preferably 1 or 2 carbon atoms, $R_8$ is an alkyl containing from 12 to 24 carbon atoms, $R_9$ is an alkyl containing from 12 to 24 carbon atoms, $R_{10}$ is hydrogen or an alkyl containing from 1 to 4 carbon atoms and X is the salt counteranion, preferably a halide, methosulphate or ethosulphate. Preferred imidazolinium salts include 3-methyl-1-(tallowyl amido)ethyl-2-tallowyl-4,4-dihydroimidazolinium methosulphate and 3-methyl-1-(palmitoyl amido)ethyl-2-octadecyl-4,5-dihydroimidazolinium chloride. Other useful imidazolinium materials are 2-heptadecyl-3-methyl-1-(2-stearylamido)-ethyl-4,5-dihydroimidazolinium chloride and 2-lauryl-3-hydroxyethyl-1-(oleylamido)ethyl-4,5-dihydro imidazolinium chloride.

Commercially available fabric softeners often contain considerable quantities of solvents, in particular isopropanol. It is desirable that the composition contains no more than about 2.5% by weight of iso-propanol or any other monohydric alcohol having 1 to 4 carbon atoms.

Additionally the composition can contain substances for maintaining stability of the product in cold storage. Examples of such substances include polyhydric alcohols such as ethylene glycol, propylene glycol, glycerol and polyethylene glycol. A suitable level for such materials is from about 0.5% to about 5%, preferably about 1.0 to 2.0% by weight.

Fabric softeners typically also include other ingredients including colorants, perfumes, preservatives, anti-foaming agents, optical brighteners, opacifiers, pH buffers, further viscosity modifiers, anti-shrinkage agents, anti-wrinkle agents, fabric crisping agents, spotting agents, soil-release agents, germicides, anti-oxidants and anti-corrosion agents.

As employed herein and in appended claims the term "perfume" is used in its ordinary sense to refer to and include any essentially water insoluble fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders and stabilizers. These auxiliaries are also included within the meaning of "perfume", as used herein. Typically, perfumes are complex mixtures of a plurality of organic compounds, which may include odoriferous or fragrant essential hydrocarbons, such as terpenes, ethers and other compounds which are of acceptable stabilities in the present compositions. Such materials are either well known in the art or are readily determinable by simple testing, and so need not be listed in detail here.

The perfumes employed in the invention will preferably be of a polar nature and lipophilic, so that they form at least a significant part of the oil phase of the microemulsion. Such perfumes will be hypochlorite-stable, of course, and it has been noted that the best perfumes for this purpose are those which are in the following olfactory families: floral, including floral, green floral, woody floral and fruity floral; chypre, including floral aldehydic chypre, leather chypre and green chypre; fougere; amber, including floral woody amber, floral spicy amber, sweet amber and semifloral amber; and leather. Such perfumes should be tested for hypochlorite stability before being used in these microemulsions.

Perfume components and mixtures thereof which can be used for the preparation of such perfumes may be natural products such as essential oils, absolutes, resinoids, resins, etc., and synthetic perfume components such as hydrocarbons, alcohols, aldehydes, ketones, ethers, acids, esters, acetals, ketals, nitriles, etc., including saturated and unsaturated compounds, aliphatic, carbocyclic and heterocyclic compounds. Examples of such perfume components are geraniol, geranyl acetate, linalool, linalyl acetate, tetrayhdrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimethylbenzylcarbinol, trichloromethylphenylcarbinyl methylphenylcarbinyl acetate, p-tert-butylcyclohexyl acetate, isononyl acetate, vetiveryl acetate, vetiverol, alpha-n-amylcinammic aidehyde, alpha-hexyl-cinammic aidehyde, 2-methyl-3-(p-tert-.butylphenyl)-propanal, 2-methyl-3-(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3-cyclohexenecarbaldehyde, 4-acetoxy-3pentyltetrahydropyran, methyl dihydrojasmonate, 2-n-heptylcyclopentanone, 3-methyl-2-pentylcyclopentanone, n-decanal, n-dodecanal, 9-decenol-1, phenoxyethyl isobutyrate, phenylacetaldehyde dimethyl acetal, phenylacetaldehyde diethyl acetal, geranonitrile, citronellonitrile, cedryl acetal, 3 -isocamphylcyclohexanol, cedryl methyl ether, isolongifolanone, aubepine nitrile, aubepine, heliotropine, coumarin, eugenol, vanillin, diphenyl oxide, hydroxycitronellal ionones, methyl ionones, isomethyl ionomes, irones, cis-3-hexenol and esters thereof, indane musk fragrances, tetralin musk fragrances, isochroman musk fragrances, macrocyclic ketones, macrolactone musk fragrances, ethylene brassylate, aromatic nitro-musk fragrances. Suitable solvents, diluents or carriers for perfumes as mentioned above are for examples; ethanol, isopropanol, diethylene, glycol monoethyl ether, dipropylene glycol, diethyl phthalate, triethyl citrate, etc.

The fabric softening compositions provided are in the form of aqueous dispersions which contain about 3 to 35% of fabric softener and from about 0.5 to 25%, preferably from about 1 to about 15% of the fragrance/surfactant complex.

The lower limits are amounts needed to contribute to effective fabric softening performance when added to laundry rinse baths in the manner which is customary in home laundry practice. The higher limits are suitable for concentrated products which provide the consumer with more economical usage because of the reduction in packaging and distribution costs.

In preparing the fragrance/surfactant mixture of the present invention, the following procedures are used. A perfume is selected and a surfactant is selected for mixture at a temperature above the melting point of the surfactant. The mixture is made using a propeller type mixer.

The fabric softener which does not contain a fragrance and is in the form of a typical base formulation is then mixed with the fragrance/surfactant component. The fragrance/surfactant preparation is added slowing up to the desired quantity and the preparation is mixed for an additional period of time in order to uniformly distribute the fragrance/surfactant preparation into the fabric softener base composition.

It is preferred that the type of surfactant used in this process be of a large hydrophilic-lipophilic balance to produce a more stable micelle. Generally, the preferred surfactants are alkoxylated ethers of fatty alcohols and especially ethoxylated cholesterol and cetyl alcohol. A commercially available material called Solulan C-24® is a suitable surfactant. The Cosmetic, Toiletry, and Fragrance Association (CTFA) has adopted the name Choleth 24 and Ceteth 24 for these materials. In this substance 24 moles of polyoxyethylene are present in the fatty alcohol complex. It has the following characteristics:

| Property | Specification |
|---|---|
| Appearance | off-white to pale yellow, waxy solid |
| Odor | faint pleasant |
| Acid value | 1.5 Max. |
| Saponification value | 3 max. |
| Hydroxyl value | 35–45 |
| Iodine value | 12–19 |
| Moisture | 0.5% Max. |
| Ash | 0.25% Max. |
| pH of 10% aq. Sol'n | 4.5–7.5 |
| Cloud point | 88–95° C. |
| Heavy metals | 20 ppm max. |
| Arsenic | 2 ppm max. |
| Microbiological count when packaged | tbc less than 10 per gram |

CTFA adopted name: CHOLETH-24 (AND) CETETH-24

The polyethylene glycol ether of cetyl alcohol known by its CFTA name as Ceteth-24 conforms to the formula:

$$CH_3(CH_2)_{14}CH_2(OCH_2CH_2)_NOH$$

where N has an average value 24.

Choleth 24 is the polyethylene glycol ether of cholesterol with an average ethoxylation value of 24.

The mixtures described herein can be formed under a variety of conditions, according to the particular ingredients chosen and the perfume to be mixed. They are mixed at a temperature at which it forms a homogeneous liquid, wherein "homogeneous" is defined as the absence of discrete solid particles or droplets of liquid in the non-aqueous phase. Low temperature processing may thus be possible for those non-ionic surfactants or surfactant mixtures that are liquid at room temperature.

A fundamental property of surfactants is their property of being adsorbed at interfaces. This property is micelle formation—the property that surface active agents have of forming colloidal size clusters in solution. Micelle formation is important because a number of important interfacial phenomena depend on the existence of micelles in solution. Evidence of the formation of micelles from the unassociated molecules of surfactant particles is a change in the conductivity of the solution. The sharp break in a curve of equivalent conductivity shows a sharp reduction in the conductivity of the solution. The concentration at which this phenomena occurs is called the critical micelle concentration or CMC. Similar breaks in almost every measurable physical property that depend on the size or number of particles and solution are shown by all types of surface active agents. The structure of micelle in aqueous media at concentrations not too far from the CMC and in the absence of additions that are solubilized by the micelle can be considered to be roughly spherical with an interior region containing the hydrophobic groups of the surface active molecules of radius approximately equal to the length of a fully extended hydrophobic group surrounded by an outer region containing the hydrated hydrophilic groups and bound water. Changes in temperature, concentration of surfactant additives in the liquid phase and structural groups in the surface active agent all may cause changes in the size, shape and aggregation number of the micelle. At least in some cases the surface active molecules are believed to form extended parallel sheets, 2 molecules thick with the individual molecules oriented perpendicular to the plane of the sheet. In aqueous solution, the hydrophilic heads of the surfactant molecules form the two parallel surfaces of the sheets and the hydrophobic tails comprise the inner region. In non-polar media, the hydrophobic groups of the surfactant molecules comprise the surfaces of the sheets; the hydrophilic groups comprise the interior. In both cases, solvent molecules occupy the region between parallel sheets of surfactants. In concentrated solution, surfactant micelles may also take the form of long cylinders packed together and surrounded by solvent. The lyophilic groups of the surfactant constitute the interior of the cylinders and the lyophobic groups comprise their exterior. These ordered arrangements of extended micellar structures are called liquid crystalline phases.

For the usual type of polyoxyethylated non-ionic surfactant, the CMC in aqueous medium decreases with decrease in the number of oxyethylene units in the polyoxyethylene chain since this makes the surfactant more hydrophobic. Since commercial polyoxyethylated non-ionics are mixtures containing polyoxyethylene chains with different numbers of oxyethylene units cluster about some mean value, their CMC values are slighter lower than those of single species materials contained the same hydrophobic group.

For non-ionic polyoxyethylated alcohols and alkylphenols in aqueous media, empirical relationships have been found between the CMC and the number of oxyethylene units R in the molecule in the formula:

$$\log C_{cmc}=A'+B'R$$

wherein A' and B' are constants depending on the surface active agents. A table of representative contents is found in "Surfactants And Interfacial Phenomena" by Milton J. Rosen, published by John Wiley & Sons, 1978, page 103.

Some amounts of organic materials such as perfumes may produce marked changes in the CMC in aqueous media. A knowledge of the effects of organic materials on the CMC of surfactants is therefore of great importance both with theoretical and practical purposes.

Two types of materials markedly affecting the critical micelle concentrations in aqueous solutions of surfactants; namely, class 1 materials which are generally polar organic compounds and class 2 materials which are at concentrations usually much higher than the class 1 materials. Class 2 materials include urea, formamide, and polyhydric alcohols such as ethylene glycol.

Choosing the correct surface active agent depends on many factors and is complicated by the fact that both phases, oil and water, are of favorable composition. The most frequently used method for selecting a suitable surface active agent is the HLB method (hydrophile-lipophile balance). In this method, on a scale to 0 to 40 it is possible to obtain an indication of the emulsification behavior of a surface active agent which is related to the balance between the hydrophilic and lipophilic portion of the molecule. A large number of commercial emulsifying agents have had an HLB number assigned to them. In some cases the HLB numbers are calculated from the structure of the molecule. The formula for some types of non-ionic surface active agents can be calculated from their structural groupings. Thus for fatty acid esters of many polyhydric alcohols the formula is:

$$HLB=20\,(1-S/A)$$

wherein S is the saponification number of the ester and A is the acid number of the fatty acid used in the ester. For esters where good saponification data is not readily obtainable, the following formula can be used:

$$HLB=E+P/5$$

wherein E is the weight percent of oxyethylene content and P is the weight percent of polyol content.

A commonly used general formula for non-ionics is:

$$HLB=20\,(M_h/M_h+M_l$$

wherein $M_l$ is the formula weight of the hydrophilic portion of the molecule and $M_l$ is the formula weight of the lipophilic portion of the molecule. See Rosen, supra.

The fragrance/surfactant composition of the present invention contain a mixture of a fragrance component and a selected surface active agent as above wherein the fragrance component is dispersed and protected by the surface active agent.

The invention thus provides for the method for producing a protected stabilized fragrance component and surface active agent and an improved fabric softener additive taken alone or further in conjunction with anti static agents and/or detergents and methods whereby various nuances can be imparted to the head space above the fabric treated with the fabric softener compositions, particularly with the wear of the fabric. These can be readily varied and controlled to produce the desired uniform character wherein one or more aromas have good initial strength and wherein one or more of the aromas is controllably released during use activity commencing with the wear of the fabric at a consisting high level over one or more extended periods of time.

Applicants have found that it is now possible to obtain a liquid fabric softener composition matter containing one or more fragrance compositions which provide fragrance release on use of extended high intensity and which permits control of viscosity so as to prevent gelation.

It is known that viscosity of a composition is a function of the concentration of the components and of temperature; i.e.

$$\eta=f(\eta_o\ T)$$

at a given temperature and concentration viscosity of the fabric softener composition can be expressed by the following relationship:

$$\eta_c=\alpha C_p^{+k1}+\beta C_s^{-k2}+\gamma C_{fs}^{+k3}+\delta(C_sC_p)^{-ky}$$

where $C_p$ is the perfume concentration $C_s$ is the surfactant concentration $C_{fs}$ is the concentration of the fabric softener base Constants $k_1$, $k_2$ etc. are dependent on the precise nature of the components. The coefficients $\alpha$, $\beta$, $\gamma$ etc. are specific for the components.

The change of viscosity $\Delta\eta$ can be expressed as:

$$\Delta\eta = \Sigma \int_{f_1}^{f_2} \left( \frac{\partial_n}{\partial_f} \right) \partial_f$$

or $$\Delta\eta = \int_{T_1}^{T_2} \left( \frac{\partial_n}{\partial T} \right) \partial T + \int_{\eta_{c1}}^{\eta_{c2}} \left( \frac{\partial_n}{\partial_{nc}} \right) \partial_{nc}$$

The viscosity of a newly formulated composition is thus a function of the original viscosity, $\eta_o$, and the change in viscosity brought about by the change in concentrations of components, $$\eta = \eta_o + \Delta\eta$$

We claim:

1. A method for controlling the viscosity of fabric softener compositions to thereby improve shelf life comprising:

forming a mixture of a perfume and a surfactant by mixing a perfume and a surfactant at a temperature where each component is in the liquid state, mixing together said mixture and a fabric softener base formulation in sufficient amounts to hereby form a fabric softener composition which avoids gelation, wherein said surfactant is polyoxyethylated ether of cholesterol and cetyl alcohol.

2. The method according to claim 1 wherein the surfactant is used in a proportion of 0.1 to 3 parts per part of perfume.

* * * * *